US006273586B1

(12) United States Patent
Schuloff

(10) Patent No.: US 6,273,586 B1
(45) Date of Patent: Aug. 14, 2001

(54) BATTERY SLEEVE FOR FLASHLIGHTS

(76) Inventor: Steve Schuloff, 125 10th St., Lakewood, NJ (US) 08701

( * ) Notice: Subject to any disclaimer, the term of this patent is extended or adjusted under 35 U.S.C. 154(b) by 0 days.

(21) Appl. No.: 09/489,996

(22) Filed: Jan. 21, 2000

(51) Int. Cl.[7] ..... F21L 4/00
(52) U.S. Cl. ..... 362/208; 362/204; 429/129
(58) Field of Search ..... 429/129; 362/189, 362/204, 202, 208, 206

(56) References Cited

U.S. PATENT DOCUMENTS 1,364,393 * 1/1921 Madigan ..... 362/208
4,135,230 1/1979 Armbruster ..... 362/206
5,016,148 * 5/1991 Kohm ..... 362/208 X
5,070,438 12/1991 Marshall ..... 362/206
5,167,447 * 12/1992 Gonzales ..... 362/202
5,317,490 5/1994 Miller ..... 362/206

* cited by examiner

*Primary Examiner*—Stephen Husar
(74) *Attorney, Agent, or Firm*—Goldstein Law Offices, P.C.

(57) ABSTRACT

A battery sleeve for flashlights including a cylindrical sleeve having an open first end and an open second end. The cylindrical sleeve has an elongated slot extending between the open first end and the open second end. The elongated slot allows for expansion of the cylindrical sleeve. The cylindrical sleeve is dimensioned for receiving a pair of batteries therein. The cylindrical sleeve is dimensioned for being received within a flashlight.

3 Claims, 3 Drawing Sheets

BATTERY SLEEVE FOR FLASHLIGHTS

BACKGROUND OF THE INVENTION

The present invention relates to a battery sleeve for flashlights and more particularly pertains to preventing batteries positioned within a flashlight from rattling.

The use of flashlight operating devices is known in the prior art. More specifically, flashlight operating devices heretofore devised and utilized for the purpose of precluding malfunction are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,135,230 to Armbruster discloses a flashlight comprised of a resilient thick-walled sleeve for holding the batteries, as part of a waterproof construction to prevent corrosion. U.S. Pat. No. 5,070,438 to Marshall and U.S. Pat. No. 5,317,490 to Miller each disclose additional flashlight constructions with tubular battery housings.

While these devices fulfill their respective, particular objective and requirements, the aforementioned patents do not describe a battery sleeve for flashlights for preventing batteries positioned within a flashlight from rattling.

In this respect, the battery sleeve for flashlights according to the present invention substantially departs from the conventional concepts and designs of the prior art, and in doing so provides an apparatus primarily developed for the purpose of preventing batteries positioned within a flashlight from rattling.

Therefore, it can be appreciated that there exists a continuing need for a new and improved battery sleeve for flashlights which can be used for preventing batteries positioned within a flashlight from rattling. In this regard, the present invention substantially fulfills this need.

SUMMARY OF THE INVENTION

In the view of the foregoing disadvantages inherent in the known types of flashlight operating devices now present in the prior art, the present invention provides an improved battery sleeve for flashlights. As such, the general purpose of the present invention, which will be described subsequently in greater detail, is to provide a new and improved battery sleeve for flashlights which has all the advantages of the prior art and none of the disadvantages.

To attain this, the present invention essentially comprises a flashlight having a light portion and a battery housing. The battery housing is dimensioned for receiving a pair of batteries therein. The battery housing has an open lower end with a spring cap removably coupled thereto. A cylindrical sleeve is provided having an open first end and an open second end. The cylindrical sleeve has an elongated slot extending between the open first end and the open second end. The elongated slot allows for expansion of the cylindrical sleeve. The cylindrical sleeve is dimensioned for receiving a pair of batteries therein. The cylindrical sleeve is dimensioned for being received within the battery housing of the flashlight. The cylindrical sleeve has a small aperture therethrough inwardly of the open first end.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved battery sleeve for flashlights which has all the advantages of the prior art flashlight operating devices and none of the disadvantages.

It is another object of the present invention to provide a new and improved battery sleeve for flashlights which may be easily and efficiently manufactured and marketed.

It is a further object of the present invention to provide a new and improved battery sleeve for flashlights which is of durable and reliable construction.

An even further object of the present invention is to provide a new and improved battery sleeve for flashlights which is susceptible of a low cost of manufacture with regard to both materials and labor, and which accordingly is then susceptible of low prices of sale to the consuming public, thereby making such a battery sleeve for flashlights economically available to the buying public.

Even still another object of the present invention is to provide a new and improved battery sleeve for flashlights for preventing batteries positioned within a flashlight from rattling.

Lastly, it is an object of the present invention to provide a new and improved battery sleeve for flashlights including a cylindrical sleeve having an open first end and an open second end. The cylindrical sleeve has an elongated slot extending between the open first end and the open second end. The elongated slot allows for expansion of the cylindrical sleeve. The cylindrical sleeve is dimensioned for receiving a pair of batteries therein. The cylindrical sleeve is dimensioned for being received within a flashlight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
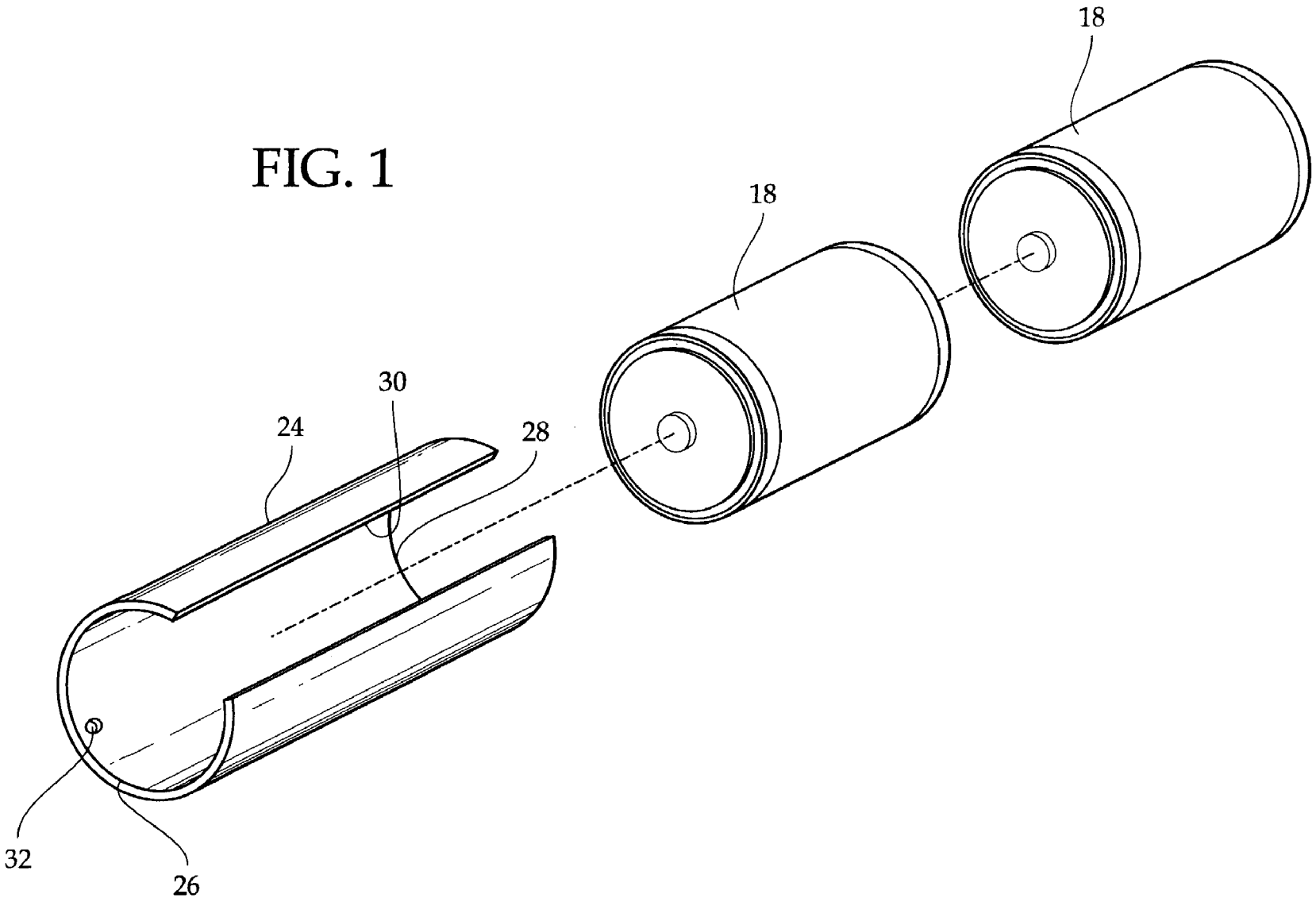
FIG. 1 is a perspective view of the preferred embodiment of the battery sleeve for flashlights constructed in accordance with the principles of the present invention.
Figure 2:
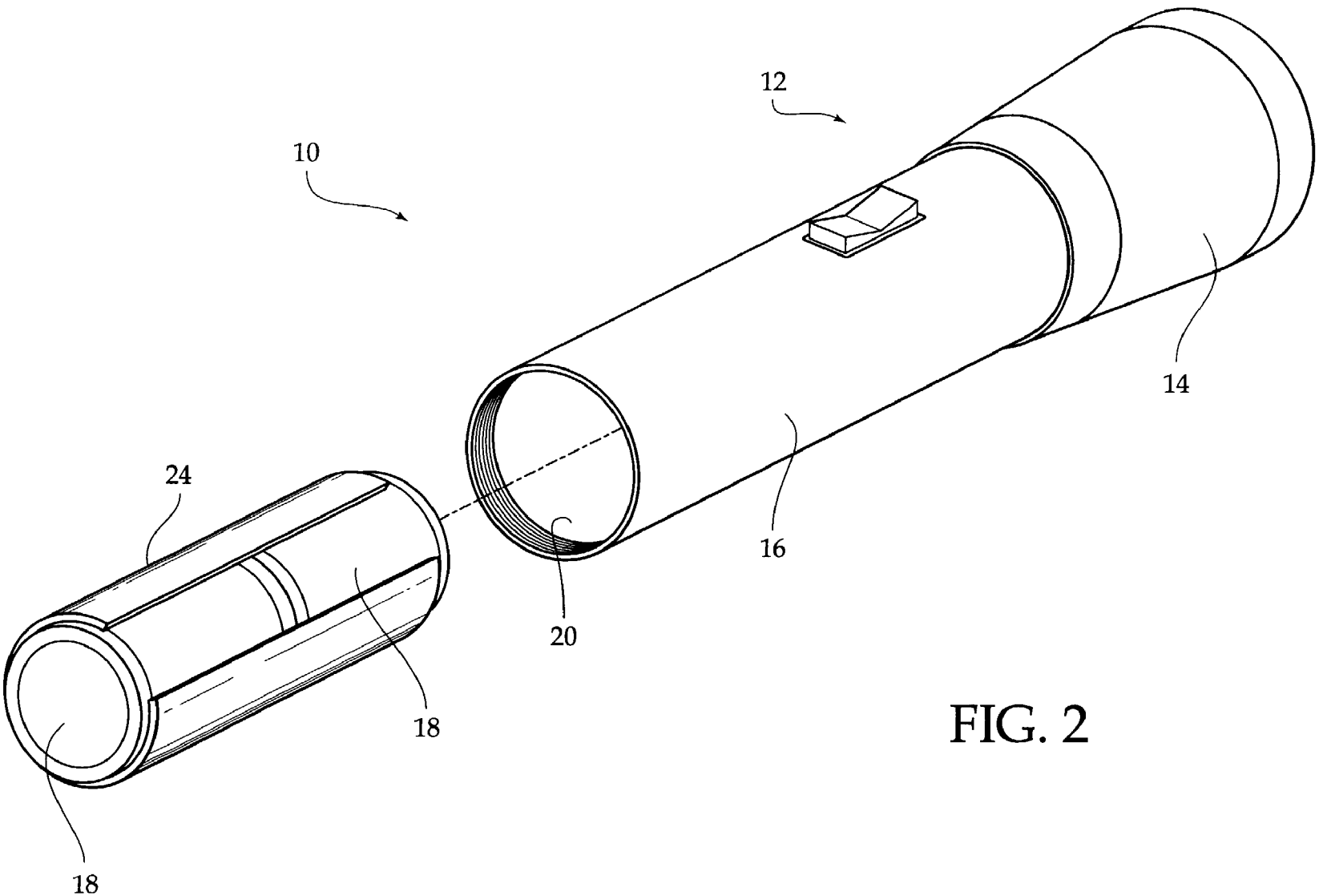
FIG. 2 is a perspective view of the present invention illustrated in use.
Figure 4:
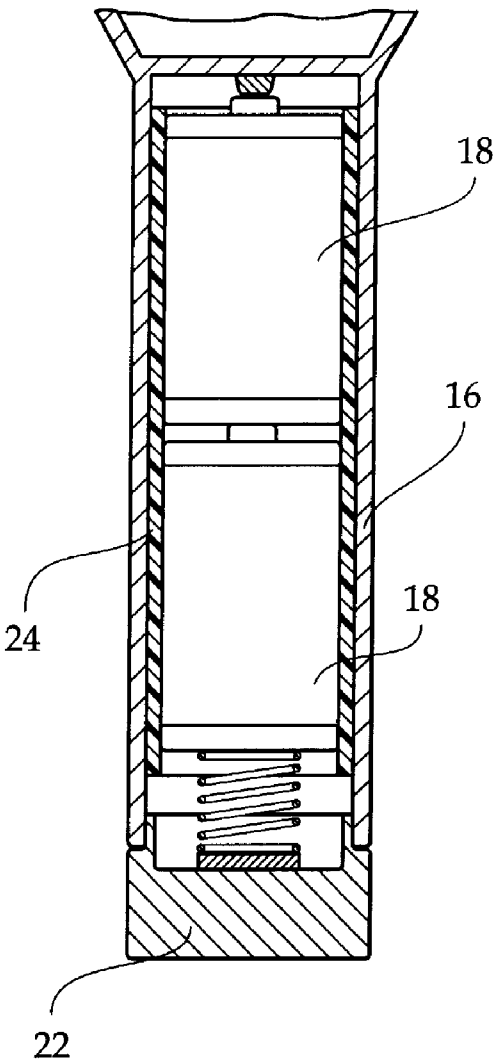
FIG. 4 is a cross-sectional view of the present invention illustrated within a flashlight.
Figure 3:
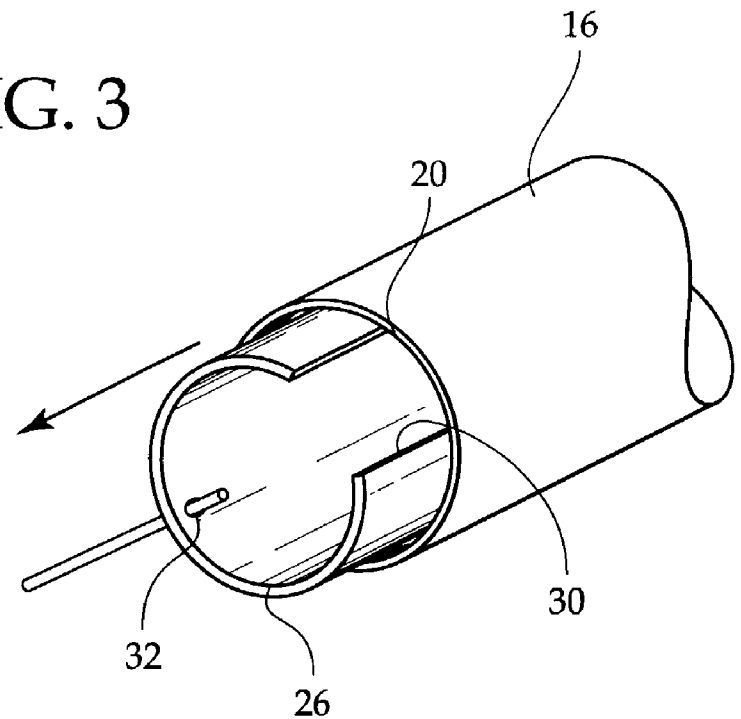
FIG. 3 is a perspective view of the present invention illustrating removal of the present invention from the flashlight.

With reference now to the drawings, and in particular, to FIGS. 1 through 4 thereof, the preferred embodiment of the new and improved battery sleeve for flashlights embodying the principles and concepts of the present invention and generally designated by the reference number 10 will be described.

Specifically, it will be noted in the various Figures that the device relates to a battery sleeve for flashlights for preventing batteries positioned within a flashlight from rattling. In its broadest context, the device consists of a flashlight and a cylindrical sleeve. Such components are individually configured and correlated with respect to each other so as to attain the desired objective.

The flashlight 12 has a light portion 14 and a battery housing 16. The battery housing 16 is dimensioned for receiving a pair of batteries 18 therein. The battery housing 16 has an open lower end 20 with a spring cap 22 removably coupled thereto. open first end 26 and the open second end 28. The elongated slot 30 allows for expansion of the cylindrical sleeve 24. The cylindrical sleeve 24 is constructed of an expandable material, such as plastic. The cylindrical sleeve 24 is dimensioned for receiving a pair of batteries 18 therein. The cylindrical sleeve 24 will expand slightly to receive the batteries 18. The cylindrical sleeve 24 is dimensioned for being received within the battery housing 16 of the flashlight 12. The cylindrical sleeve 24 has a small aperture 32 therethrough inwardly of the open first end 26.

In use, the batteries 18 are placed within the cylindrical sleeve 24. The cylindrical sleeve 24 will expand so that the batteries 18 will be prevented from moving within the sleeve 24. Note FIG. 2. The cylindrical sleeve 24 is then placed within the battery housing 16. The sleeve 24 will snugly abut the interior of the battery housing 16 so that movement will be minimized if not precluded. Operation of the flashlight 12 will remain the same. The open first and second ends 26,28 allow contacts of the flashlight 12 and batteries 18 to meet. The small aperture 32 is provided so that a pin 34 or other object can be used to facilitate the removal of the sleeve 24 from the battery housing 16. Note FIG. 3.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A battery sleeve for flashlights for preventing batteries positioned within a flashlight from rattling comprising, in combination:

a flashlight having a light portion and a battery housing, the battery housing dimensioned for receiving a pair of batteries therein, the battery housing having an open lower end with a spring cap removably coupled thereto;

a cylindrical sleeve having an open first end and an open second end, the cylindrical sleeve having an elongated slot extending between the open first end and the open second end, the elongated slot allowing for expansion of the cylindrical sleeve, the cylindrical sleeve being dimensioned for receiving a pair of batteries therein, the cylindrical sleeve being dimensioned for being received within the battery housing of the flashlight, the cylindrical sleeve having a small aperture therethrough inwardly of the open first end.

2. A battery sleeve for flashlights for preventing batteries positioned within a flashlight from rattling comprising, in combination:

a cylindrical sleeve having an open first end and an open second end, the cylindrical sleeve having an elongated slot extending between the open first end and the open second end, the elongated slot allowing for expansion of the cylindrical sleeve, the cylindrical sleeve being dimensioned for receiving a pair of batteries therein, the cylindrical sleeve being dimensioned for being received within a flashlight.

3. The battery sleeve for flashlights as set forth in claim 2 wherein the cylindrical sleeve has a small aperture therethrough inwardly of the open first end.

* * * * *